United States Patent [19]

Okamura

[11] Patent Number: 4,900,173

[45] Date of Patent: Feb. 13, 1990

[54] METHOD AND APPARATUS FOR FEEDING SHEET

[75] Inventor: Shigeru Okamura, Kawasaki, Japan

[73] Assignee: Canon Kabushiki Kaisha, Tokyo, Japan

[21] Appl. No.: 305,092

[22] Filed: Feb. 2, 1989

[30] Foreign Application Priority Data

Feb. 5, 1988 [JP] Japan ..... 63-25362
Feb. 5, 1988 [JP] Japan ..... 63-25363

[51] Int. Cl.[4] ..... B41J 11/50

[52] U.S. Cl. ..... 400/606; 400/608.3; 400/708; 271/9; 271/265; 346/134

[58] Field of Search ..... 270/1.1, 52; 355/79, 355/108, 104; 271/9, 265, 261, 259, 266; 400/605, 606, 607, 607.2, 608.3, 708; 354/301; 346/134

[56] References Cited

U.S. PATENT DOCUMENTS 4,521,785 6/1985 Matsufuji ..... 346/134
4,594,013 6/1986 Costa et al. ..... 271/9
4,595,931 6/1986 Toganoh et al. ..... 346/25
4,617,580 10/1986 Miyakawa ..... 346/140 R

*Primary Examiner*—H. Grant Skaggs
*Attorney, Agent, or Firm*—Fitzpatrick, Cella, Harper & Scinto

[57] ABSTRACT

A sheet feeding apparatus for feeding a sheet to a recording station by means of rollers, comprising an automatic OHP sheet feeder, wherein the fact whether a sheet being fed is an OHP sheet or a separating sheet is discriminated; if the sheet is the OHP sheet, the sheet is advanced by a predetermined amount, and is retracted by a predetermined amount into a waiting passage; then, another sheet is supplied and the fact that the another sheet is a separating sheet is confirmed; and thereafter, images or characters are recorded on the OHP sheet, while feeding the OHP sheet and the separating sheet altogether in an overlapped condition.

7 Claims, 4 Drawing Sheets

METHOD AND APPARATUS FOR FEEDING SHEET

BACKGROUND OF THE INVENTION

1. Field of the Invention

The present invention relates to a method and an apparatus for feeding a sheet, used with recording systems, and more particularly, it relates to a sheet feeding method and apparatus adapted to feed a transparent plastic sheet.

2. Related Background Art

In the past, a transparent plastic sheet has been exclusively used as a sheet for an OHP (overhead projector) (referred to as "OHP sheet" hereinafter), which included a recording or printing surface constituted by, for example, a coating layer coated on a polyester sheet.

The OHP sheet has been used for recording or displaying thereon images or characters by means of an overhead projector (OHP).

As to the OHP sheet, a sheet having coating layers on both of its surfaces has generally been used, for the reason that, if such coating layer is provided on only one of the surfaces thereof, the sheet will be in danger of curling due to heat and/or moisture generated in the recording operation.

However, in the conventional recording system, there arose a problem that when the images were printed on the OHP sheet having the coating layers on both surfaces thereof the coating material adhered to a heater of a fixing device to smear the heater and/or the next OHP sheet.

Further, in general, the OHP sheet is sold in the market as a stack or laminated package in which the OHP sheets and plain sheets (as separating sheets) are stacked or laminated alternately. If such stacked sheets are used as they are in the conventional recording system, the OHP sheet and the plain sheets are alternately fed one by one in a recording station of the recording system. Accordingly, in this case, there arises a problem that not only the plain sheets (separating sheets) must be prevented from being fed in the recording station, but also the coating material on both surfaces of each OHP sheet adheres to the heater of the fixing device to smear the heater and/or the next OHP sheet as mentioned above.

In order to solve this problem, a method for feeding OHP sheets properly by preventing adhesion of the OHP sheet to a paper holder plate in a high temperature and high moisture condition has been proposed, as described in the Japanese Patent Laid-Open No. 61-173971 (corresponding to U.S. Ser. No. 820,747 filed on Jan. 22, 1986 now abandoned). According to the proposed method, a plurality of ridges or projections were formed on a surface of the paper holder plate on which the OHP sheet was guided, thereby reducing friction between the OHP sheet and the paper holder plate to prevent oblique movement and/or uneven feeding of the OHP sheet even in the high temperature and high moisture condition.

However, even if the method described in the above Japanese Patent Laid-Open No. 61-173971 was used, the drawback that the coating material of the OHP sheet having the coating layers on both of its surfaces adhered to the heater of the fixing device to smear the heater and/or the next OHP sheet could not be eliminated completely.

SUMMARY OF THE INVENTION

An object of the present invention is to eliminate the above-mentioned conventional drawback, and more particularly, to eliminate the inconvenience that the coating material adheres to the heater of the fixing device, by recording images or characters on an OHP sheet while feeding the OHP sheet with a plain sheet overlapped on its back surface.

Another object of the present invention is to automatically feed an OHP sheet with a plain sheet overlapped on its back surface to a recording station.

Other objects of the present invention will be apparent from the detailed description regarding embodiments of the present invention mentioned below.

DESCRIPTION OF THE PREFERRED EMBODIMENTS

The present invention will now be explained with reference to the accompanying drawings.

First of all, a first embodiment of the present invention will be described in connection with FIGS. 1 to 3.

Figure 1:
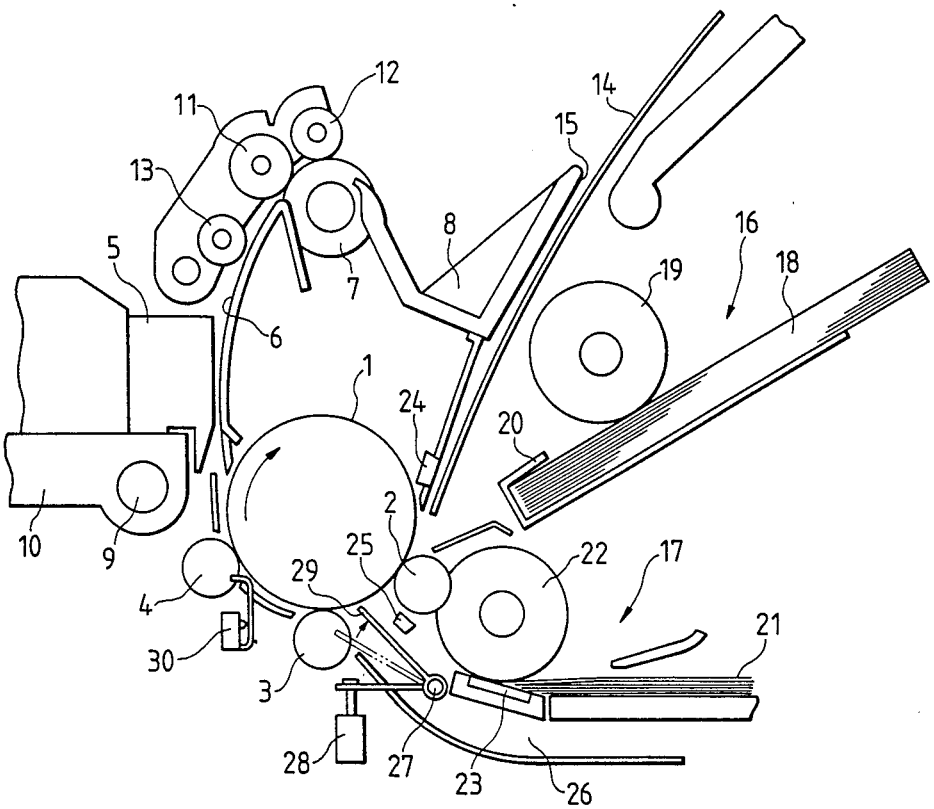
FIG. 1 is a side view of a recording system adapted to perform an OHP sheet feeding method according to a first embodiment of the present invention.

FIG. 1 shows a side view of a recording system adapted to carry out an OHP sheet feeding method according to the present invention.

In FIG. 1, three pinch rollers 2, 3, 4 are releasably pressed against a lower portion of a peripheral surface of a feed roller 1 acting as a main roller in a sheet feeding section of the recording system. An OHP sheet (recording medium) is fed, by the feed roller 1, in front of a recording head 5. After images or characters are recorded on the OHP sheet, the OHP sheet is moved along a guide 6 also acting as a heater of a fixing device and is ejected upwardly by means of an ejector roller 7 to be collected in a stacker 8.

An illustrated recording system is a serial ink jet recording system wherein the recording head 5 is mounted on a carriage 10 which can be shifted along a slide shaft 9 in a longitudinal direction thereof.

The ejector roller 7 cooperates with two self-aligned rollers 11, 12 to form a pair of rollers constituting an ejector mechanism for lifting up the sheet to be ejected.

Further, downstream of the recording head 5, there is arranged a guide roller 13 for preventing the flying of a trailing end of the sheet that has left the recording head 5.

Upstream of the feed roller 1, there is arranged a sheet feed mechanism (for feeding the OHP sheet and the like) which is constituted by a manual sheet feeding inlet means 15, an automatic cut sheet (plain sheet) feeder 16 and an automatic OHP sheet feeder 17, which are disposed in order from the top down.

The automatic cut sheet feeder 16 is a device for feeding plain sheets 18 of a predetermined dimension one by one onto the peripheral surface of the feed roller 1 in the vicinity of the first pinch roller 2 and comprises a sheet feeding roller 19, a sheet separating pawl 20 and the like.

The automatic OHP sheet feeder 17 is constituted by a separating roller 22 and a separating plate 23 and operates to separate single uppermost sheets one by one from a sheet stack 21 comprising OHP sheets and separating sheets overlapped or laminated alternately and to feed such single sheets toward the feed roller 1.

A reflecting type sheet sensor 24 is arranged upstream of a contacting portion between the feed roller 1 and the first pinch roller 2, and a reflecting type sheet sensor 25 is arranged in the vicinity of an outlet of the automatic OHP sheet feeder 17.

Downstream of the automatic OHP sheet feeder 17, there is arranged a waiting passage 26 for temporarily receiving the sheet at a position out of the sheet feeding section.

At the boundary between the outlet of the automatic OHP sheet feeder 17 and an inlet of the waiting passage 26, there is disposed a mechanical guide 29 pivotally mounted on a pin 27 and rotatingly driven by a solenoid 28.

The mechanical guide 29 is biased by a return spring (not shown) toward a direction shown by an arrow in FIG. 1 (i.e., in a clockwise direction) so that the mechanical guide is maintained in a position shown by a solid line when the solenoid 28 is deenergized (OFF state). However, when the solenoid is turned ON, the mechanical guide 29 is shifted to a position shown by a two-dot chain line.

Further, an additional mechanical sheet sensor 30 is arranged in the vicinity of a contacting portion between the feed roller 1 and the third pinch roller 4. The sheet sensor 30 is used for positioning the leading edge of the sheet to be fed in a recording section of the recording system.

Next, in the recording system shown in FIG. 1, a sheet feeding operation performed when the OHP sheet 14 is manually introduced from the manual sheet feeding inlet means 15 into the recording system will be explained.

When the transparent OHP sheet 14 is introduced from the manual sheet feeding inlet means 15 into the recording system, whether the transparent OHP sheet 14 is introduced or not cannot be detected by means of the reflecting type sheet sensor 24 alone. However, when the introduced sheet passes through the first pinch roller 2 and encounters the sheet sensor 30, the fact that the introduced sheet is the transparent OHP sheet is confirmed (since, the introduced sheet was not detected by the reflecting type sensor 24, but was detected by the mechanical sensor 30).

When the OHP sheet is confirmed, the solenoid 28 is energized (i.e., turned ON) to shift the mechanical guide 29 to the position shown by the two-dot chain line. Then, the feed roller 1 is rotated in the positive (clockwise) direction by a predetermined amount to advance the OHP sheet until the trailing edge of the OHP sheet exceeds the mechanical guide 29.

Thereafter, the feed roller 1 is rotated in the reverse (anti-clockwise) direction by a predetermined amount to retract the OHP sheet by a predetermined amount into the waiting passage 26 disposed out of the sheet feeding path. In this condition, the leading edge of the OHP sheet is maintained as it is pinched between the feed roller 1 and the second pinch roller 3.

Then, the sheet feeding roller 19 of the automatic cut sheet feeder 16 is driven to feed a single plain sheet to the contacting portion between the feed roller 1 and the first pinch roller 2.

Thereafter, by rotating the feed roller 1 in the positive direction again, the OHP sheet 14 and the plain sheet (cut sheet 18) are sent to the recording station while they overlap each other.

In this way, the overlapped or laminated sheets (wherein the OHP sheet is situated in a front side confronting the recording head 5 and the plain sheet is situated in a back side confronting the fixing heater 6) are fed to the recording station at a predetermined pitch, thereby recording the images and the like on the OHP sheet.

The recorded OHP sheet with the plain sheet on its back surface is ejected into the stacker 8 by means of the ejector roller 7.

Figure 2:
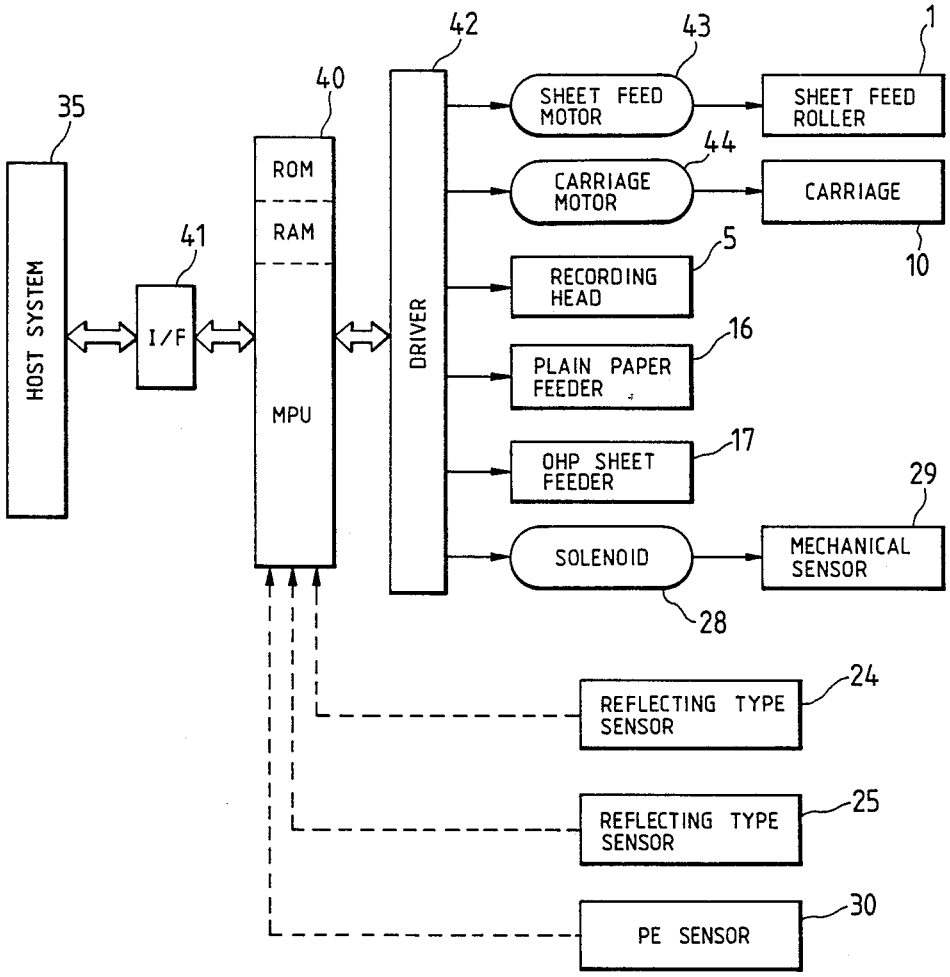
FIG. 2 is a block diagram of a control portion of the recording system of FIG. 1.

FIG. 2 shows a block diagram of a control portion of the recording system adapted to carry out the OHP sheet feeding method mentioned above.

In FIG. 2, a microprocessor 40 for controlling the operation of the recording system receives recording (printing) data and command data from a host system 35 through an interface 41, and controls a sheet feed motor 43, a carriage motor 44, the recording head 5, the automatic cut sheet feeder 16, the automatic OHP sheet feeder 17, the solenoid 28 and the like, through a driver 42, on the basis of these data and various input informations from the sensors and the like.

The microprocessor 40 includes a ROM storing programs therein, a RAM for storing the recording data and the input information on occasion, and the like, and further includes a control circuit which receives detection signals from the reflecting type sheet sensors 4, 25, the mechanical guide 29 and/or the PE sensor (sheetless or non-sheet sensor) 30 to output a predetermined control signal corresponding to the detection signal.

Figure 3:
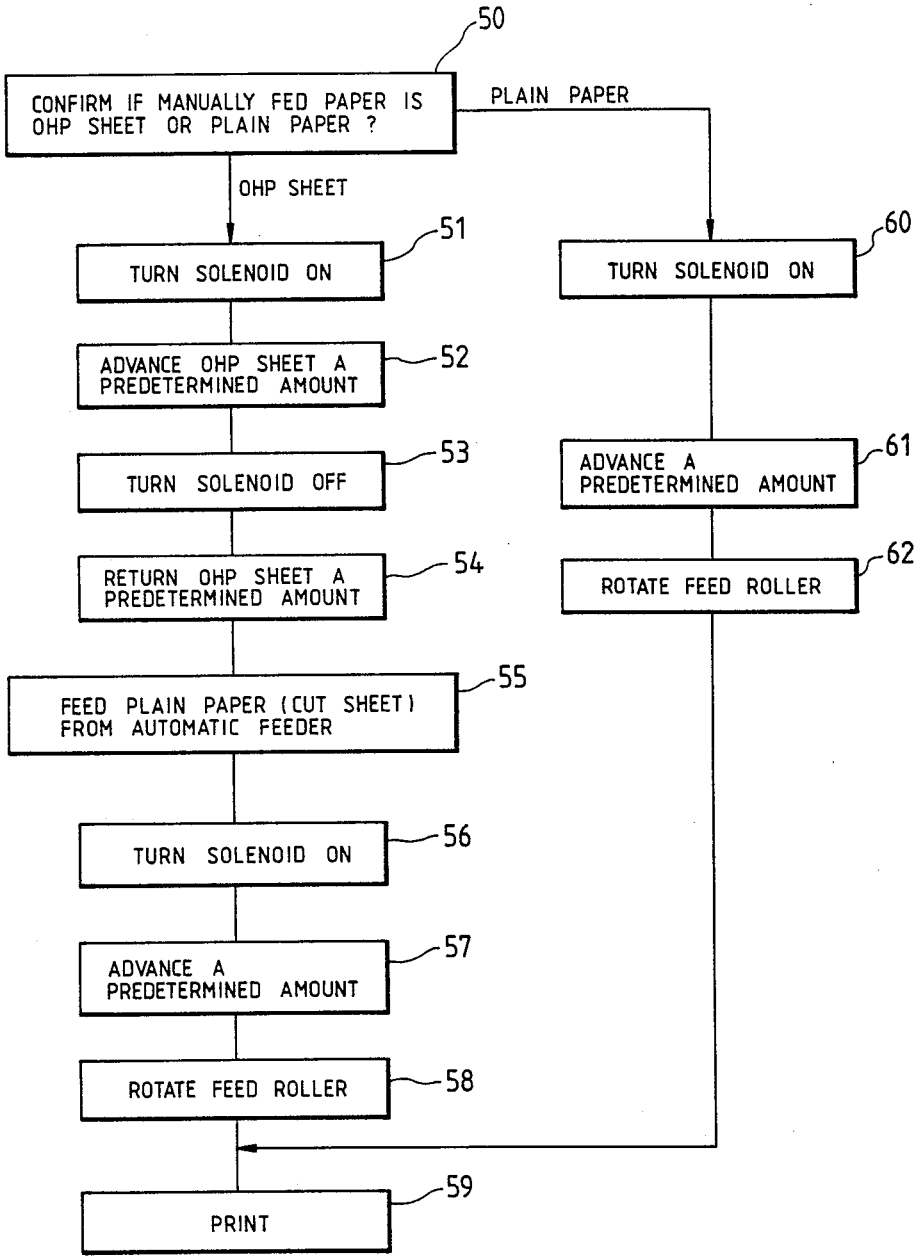
FIG. 3 is a flow chart showing an operating sequence executed in the sheet feeding method by means of the recording system of FIGS. 1 and 2.

FIG. 3 shows a flow chart regarding an operation sequence executed in the sheet feeding method mentioned above.

In FIG. 3, a step 50 determines whether the sheet introduced from the manual sheet feeding inlet means 15 is an OHP sheet or a plain sheet. When the step 50 confirms the fact that the introduced sheet is the transparent OHP sheet other than the plain sheet, the solenoid 28 is turned ON in a step 51, thus rotating the feed roller 1 in a step 52 to advance the OHP sheet by a predetermined amount. Thereafter, the solenoid 28 is turned OFF in a step 53.

Subsequently, in a step 54, the feed roller 1 is rotated in the reverse direction to retract the OHP sheet by a predetermined amount into the waiting passage 26 situated out of the sheet feeding path.

Then, in a step 55, the cut sheet (plain sheet) acting as a separating sheet (or backing sheet) for the OHP sheet is fed out from the automatic cut sheet feeder 16 by means of the sheet feeding roller 19; then, in a step 56, by turning the solenoid 28 ON again, the cut sheet is advanced by a predetermined amount (in a step 57), thus feeding the cut sheet to the contacting portion between the feed roller 1 and the first pinch roller 2.

Then, the feed roller 1 and the sheet feeding roller 19 are simultaneously rotated (in a step 58) to feed the OHP sheet and the cut sheet in the overlapped condition to the recording station, and the images or characters are recorded or printed onto the OHP sheet (in a step 59). In this case, the OHP sheet is positioned in confronting relation with the recording head 5, whereas the plain sheet is positioned at an opposite side to which the fixing heater 6 belongs.

On the other hand, when the step 50 determines the fact that the introduced sheet is a plain sheet, the sequence goes to a step 60, where the solenoid 28 is turned ON, and, in a next step 61, the plain sheet is advanced by a predetermined amount. Then, in a step 62, the feed roller 1 is rotated. Subsequently, the sequence goes to the step 59, where the images or characters are recorded on the plain sheet.

According to the OHP sheet feeding method as mentioned above, when the recording operation is effected with respect to the OHP sheet 14 introduced from the manual sheet feeding inlet means 15, since the plain sheet 18 fed from the cut sheet feeder 16 is overlapped onto the back of the OHP sheet as the backing sheet, it is possible to effectively prevent the coating layers of the OHP sheet from contacting and slipping on the fixing heater 6, thus eliminating adhesion of the coating material onto the fixing heater to smear the latter and the like.

Further, it is very convenient that the plain sheet used as the backing sheet can also be used as a separating sheet after it has been ejected together with the OHP sheet.

Next, a second embodiment of the present invention will now be explained with reference to FIGS. 1, 2 and FIG. 4. However, since the construction of the recording system shown in FIGS. 1 and 2 has already been fully described, the detailed explanation of the recording system will be omitted here.

First of all, a sheet feeding operation in which the OHP sheet and separating sheet are automatically fed from the automatic OHP sheet feeder 17 in the recording system of FIG. 1 will be explained.

By driving the separating roller 22 of the automatic OHP sheet feeder 17, an uppermost sheet is separated from the sheet stack 21 and is fed from the automatic OHP sheet feeder 17. When the fed sheet passes through the reflecting type sensor 25 and reaches the mechanical sensor 30, it can be discriminated whether the fed sheet is an OHP sheet or is a separating sheet.

In this discrimination, the fact that the fed sheet is the OHP sheet (transparent sheet) is confirmed or determined when the fed sheet was not detected by the reflecting type sensor 25 but was detected by the mechanical sensor 30; whereas, when the fed sheet was detected by both sensors 25, 30, the fact that the fed sheet is the separating sheet (plain sheet) is determined.

If the fed sheet is the transparent OHP sheet, the solenoid 28 is turned ON to shift the mechanical guide 29 to the position shown by the two-dot chain line position, and then, the feed roller 1 is rotated in the positive direction by a predetermined amount to advance the OHP sheet until the trailing edge of the OHP sheet exceeds the mechanical guide 29. Thereafter, the solenoid 28 is turned OFF to return the mechanical guide 29 to the position shown by the solid line. Subsequently, the feed roller 1 is rotated in the reverse direction by a predetermined amount to retract the OHP sheet by a predetermined amount into the waiting passage 26 situated out of the sheet feeding path. It should be noted that, in this condition, the leading edge of the OHP sheet is maintained in the sheet feeding path by being pinched between the feed roller 1 and the second pinch roller 3.

Now, the separating roller 22 of the automatic OHP sheet feeder 17 is rotated again to feed a new uppermost sheet from the sheet stack 21. In this case, the new fed sheet is expected to be a plain sheet (separating sheet); this fact is confirmed by the reflecting type sensor 25.

Next, the solenoid 28 is turned ON again to shift the mechanical guide 29 to the position shown by the two-dot chain line. Then, the separating roller 22 is further rotated to advance the separating sheet until the leading edge of the separating sheet abuts against the contacting portion between the feed roller 1 and the second pinch roller 3.

In this way, the separating sheet is inserted between the OHP sheet and the feed roller 1 to enable the simultaneous feeding of the OHP sheet and separating sheet. Here, by rotating the feed roller (main roller) 1 in the positive direction, the overlapped sheets are fed altogether through the recording station, where the images and the like are recorded on the OHP sheet facing the recording head 5.

On the other hand, if the firstly fed sheet is the separating sheet, the solenoid 28 is turned ON to shift the mechanical guide 29 to the position shown by the two-dot chain line, and then, the feed roller 1 is rotated in the positive direction to advance the separating sheet by a predetermined amount until the trailing edge of the separating sheet reaches near the second pinch roller 3. Next, the feed roller 1 is rotated in the reverse direction while the solenoid 28 is kept in the ON state, thereby retracting the separating sheet by a predetermined amount along the sheet feeding path including the first pinch roller 2. In this condition, the separating sheet is held by both of the first and second pinch rollers 2 and 3.

Now, the solenoid 28 is turned OFF to return the mechanical guide 29 to the position shown by the solid line. Thereafter, the separating roller 22 of the automatic OHP sheet feeder 17 is driven again to feed a new uppermost sheet from the sheet stack 21. In this case, the new fed sheet is expected to be an OHP sheet; this fact is confirmed by the reflecting type sensor 25.

Next, the solenoid 28 is turned ON again to shift the mechanical guide 29 to the position shown by the two-dot chain line. Then, the separating roller 22 is further rotated to advance the OHP sheet until the leading edge of the OHP sheet abuts against the contacting portion between the feed roller 1 and the second pinch roller 3.

In this way, the OHP sheet is inserted between the separating sheet and the second pinch roller 3 to enable the simultaneous feeding of the OHP sheet and separating sheet. Here, by rotating the feed roller 1 in the positive direction, the overlapped sheets are fed altogether through the recording station, where the images and the like are recorded on the OHP sheet facing the recording head 5.

Accordingly, it is possible to feed the OHP sheet and the separating sheet altogether, while overlapping the separating sheet on the OHP sheet as the backing sheet, thus preventing the coating material of the OHP sheet from contacting the fixing heater 6 to smear the latter.

The recorded OHP sheet is ejected together with the separating sheet by means of the ejector roller 7 into the stacker 8, whereby the recorded OHP sheets can be stored in the stacker 8 in the condition that the OHP sheets and the separating sheets are laminated alternately.

Figure 4:
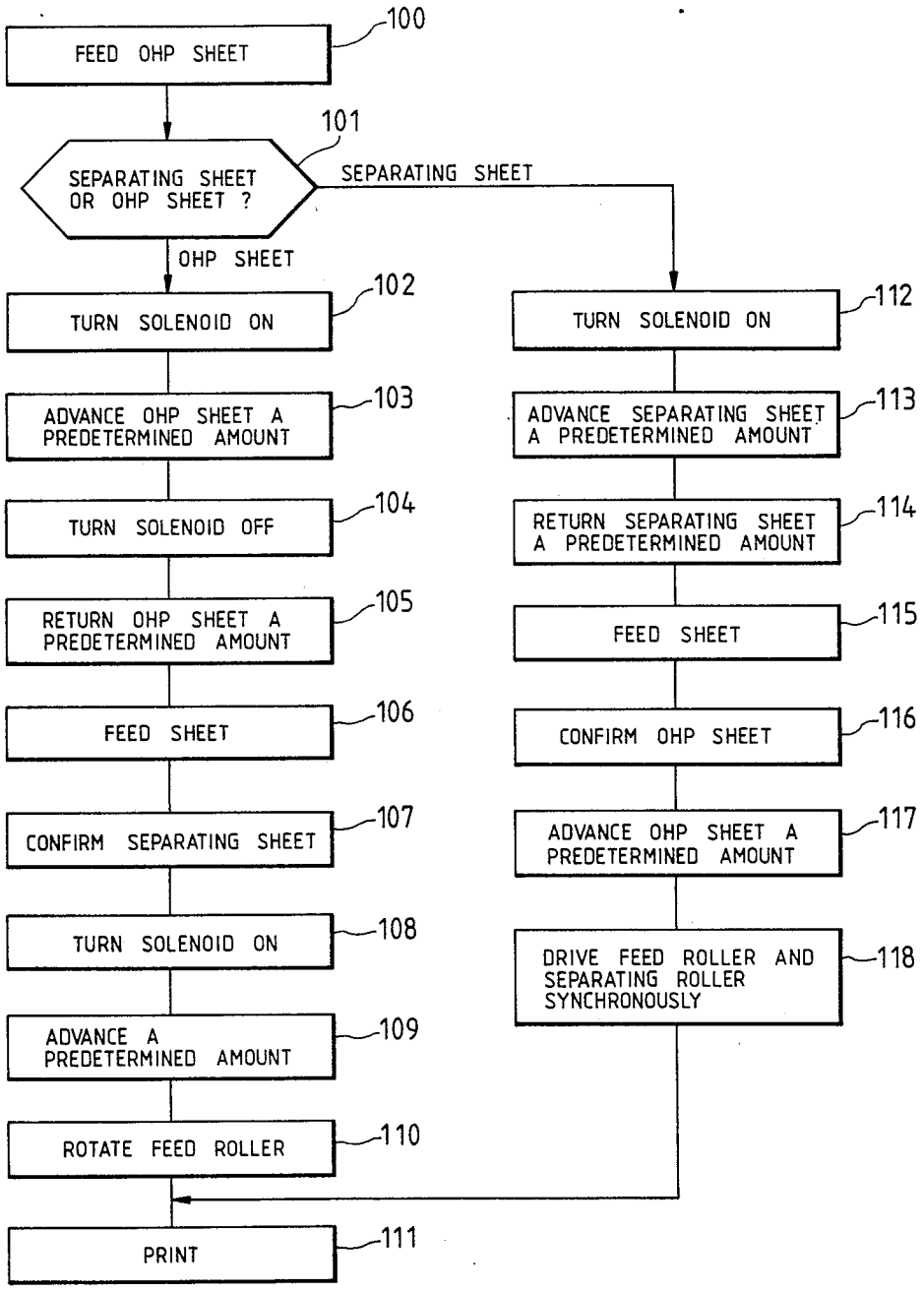
FIG. 4 is a flow chart showing an operating sequence executed in an OHP sheet feeding method according to another embodiment by means of the recording system of FIGS. 1 and 2.

Explaining the sequence of the above-mentioned sheet feeding operation with reference to a flow chart shown in FIG. 4, when the demand for feeding the OHP sheet is given in a step 100, the separating roller 22 of the automatic OHP sheet feeder 17 is rotatingly driven to pick up and feed a single uppermost sheet from the sheet stack 21.

Next, a step 101 discriminates whether the fed sheet is the OHP sheet or the separating sheet by means of the sensors 25 and 30.

If the fed sheet is the OHP sheet, in a step 102, the solenoid 28 is turned ON, and the feed roller 1 is rotated to advance the OHP sheet by a predetermined amount in a step 103, and then, the solenoid is turned OFF in a step 104.

Subsequently, in a step 105, the feed roller 1 is rotated in the reverse direction to retract the OHP sheet by a predetermined amount into the waiting passage 26 situated out of the sheet feeding path.

Next, in a step 106, the separating roller 22 is rotated again to feed out a new single sheet, and the fact that the newly fed sheet is the separating sheet is confirmed in a step 107. Then, in a step 108, the solenoid 28 is turned ON to advance the separating sheet by a predetermined amount (in a step 109) to bring the separating sheet to the peripheral surface of the feed roller 1.

Subsequently, the feed roller 1 and the separating roller 22 are simultaneously rotated to feed the OHP sheet and the separating sheet altogether in the overlapped condition (in a step 110), and then, in a next step 111, the images and the like are recorded on the OHP sheet.

On the other hand, if the firstly fed sheet is determined as the separating sheet in the step 101, the sequence goes to a step 112, where the solenoid 28 is turned ON, and the separating sheet is advanced by a predetermined amount in a next step 113, and further, in a step 114, the separating sheet is retracted by a predetermined amount along the sheet feeding path, while the solenoid 28 is kept in the ON state.

Then, in a step 115, the separating roller 22 is rotated again to feed out a next OHP sheet, and the fact that the newly fed sheet is the OHP sheet is confirmed by the sensor 25 (in a step 116). In a next step 117, the OHP sheet is advanced toward the periphery of the feed roller 1 to enable the feeding of the OHP sheet.

In a next step 118, the feed roller 1 and the separating roller 22 are simultaneously rotated to feed the OHP sheet and the separating sheet altogether in the overlapped condition. Then, the sequence goes to the step 111, where the images are recorded on the OHP sheet with the backing sheet.

According to the sheet feeding method as mentioned above, since the OHP sheet can be fed automatically from the automatic OHP sheet feeder and the separating sheet can be used as the backing sheet, it is possible to eliminate the inconvenience that the coating layer of the OHP sheet contacts the fixing heater 6 to smear the same and the like.

Further, the operability is improved, since the separating sheet can be used as the separating sheet as it is, after it has been ejected together with the OHP sheet.

As mentioned above, according to the present invention, since the OHP sheet can be fed together with the separating sheet in the overlapped condition, even if the OHP sheet having the coating layers on both of its surfaces is used, there is no contamination due to the coating material and there is no risk of adhesion of the OHP sheet to the sheet feeding path. Further, the OHP sheet can be ejected while automatically including the separating sheet.

What is claimed is:

1. A method for feeding a sheet in a sheet feeding apparatus used with a recording system, comprising the steps of:

discriminating whether a sheet being fed is a transparent plastic sheet or not;

when said sheet is the transparent plastic sheet, advancing said sheet by a predetermined amount, and then retracting said sheet by a predetermined amount into a waiting passage;

supplying a plain sheet; and recording images or characters on said transparent plastic sheet, while feeding said transparent plastic sheet and said plain sheet altogether in an overlapped condition.

2. A sheet feeding method according to claim 1, wherein said transparent plastic sheet comprises an OHP sheet.

3. A sheet feeding method according to claim 1, wherein said transparent plastic sheet is supplied from a manual feeding inlet means.

4. A sheet feeding apparatus comprising:

a sheet feeding path for conveying a sheet;

a waiting passage situated out of said sheet feeding path;

discriminating means for discriminating whether a sheet supplied to said sheet feeding path is a transparent plastic sheet or not;

distribution means for selectively distributing said supplied sheet to either said sheet feeding path or said waiting passage when said supplied sheet is retracted, the selective distribution by said distribution means being determined in accordance with a result of the discrimination due to said discriminating means; and control means for advancing said supplied sheet by a predetermined amount and then retracting said sheet into either said sheet feeding path or said waiting passage through said distribution means and then supplying another sheet and advancing said sheet and said another sheet altogether in an overlapped condition.

5. A sheet feeding apparatus according to claim 4, wherein said transparent plastic sheet is an OHP sheet.

6. A sheet feeding apparatus according to claim 5, further comprising an automatic OHP sheet feeder including a sheet stack constituted by the OHP sheets and separating sheets laminated alternately, and wherein said sheet supplied to said sheet feeding path is either the OHP sheet or the separating sheet.

7. A sheet feeding apparatus according to claim 6, wherein said discriminating means operates for driving said distribution means to guide said OHP sheet into said waiting passage when the OHP sheet is confirmed, and for driving said distribution means to guide said separating sheet into said sheet feeding path when the separating sheet is confirmed.

* * * * *

UNITED STATES PATENT AND TRADEMARK OFFICE

CERTIFICATE OF CORRECTION

PATENT NO. : 4,900,173

DATED : February 13, 1990

INVENTOR(S) : SHIGERU OKAMURA

It is certified that error appears in the above-identified patent and that said Letters Patent is hereby corrected as shown below:

COLUMN 4, line 35, "4" should read --24--.

Signed and Sealed this

Eighth Day of January, 1991

*Attest:*

HARRY F. MANBECK, JR.

*Attesting Officer*

*Commissioner of Patents and Trademarks*